United States Patent [19]

Kato et al.

[11] Patent Number: 4,629,031

[45] Date of Patent: Dec. 16, 1986

[54] SOUNDPROOF ENGINE-OPERATED MACHINE

[75] Inventors: Shoichi Kato; Teisuke Tsukamoto, both of Saitama, Japan

[73] Assignee: Honda Giken Kogyo Kabushiki Kaisha, Tokyo, Japan

[21] Appl. No.: 768,653

[22] Filed: Aug. 23, 1985

[30] Foreign Application Priority Data

Aug. 24, 1984 [JP] Japan ..... 59-128313[U]
Aug. 30, 1984 [JP] Japan ..... 59-131653[U]

[51] Int. Cl.[4] ..... F01N 1/08

[52] U.S. Cl. ..... 181/204; 181/202; 181/225

[58] Field of Search ..... 181/202, 204, 205, 225; 417/234, 312, 364, 380; 123/198 C,198 E

[56] References Cited

U.S. PATENT DOCUMENTS 2,177,687 10/1939 Bracken et al. ..... 181/204 X
3,856,439 12/1974 Moehrbach ..... 181/204 X
3,951,114 4/1976 Fachbach et al. ..... 181/204 X

FOREIGN PATENT DOCUMENTS 56-8817 1/1981 Japan .
57-10418 1/1982 Japan .
58-109519 7/1983 Japan .

*Primary Examiner*—Benjamin R. Fuller
*Attorney, Agent, or Firm*—Armstrong, Nikaido, Marmelstein & Kubovcik

[57] ABSTRACT

A soundproof engine-operated machine or generator includes a floor having first and second air discharge hole, wall members cooperating with the floor in defining a container, at least one wall member having an air inlet for introducing air into the container, a water-cooled engine disposed in the container, a first cooling fan disposed in front of said engine for delivering air from said air inlet toward said engine to cool the engine, a machine unit such as a generator operable by the water-cooled engine, a radiator attached to the engine, a second cooling fan disposed in front of the radiator for drawing air from behind the radiator therethrough, an exhaust pipe connected to the engine and extending below the floor, a muffler connected to a downstream portion of the exhaust pipe and disposed below the floor, a duct for guiding air from the engine around the exhaust pipe to cool the exhaust pipe and for discharging the air through the first air discharge hole, and a scroll-shaped fan cover for discharging air from the radiator through the second air discharge hole to cool the muffler positioned below the second air discharge hole.

10 Claims, 8 Drawing Figures

SOUNDPROOF ENGINE-OPERATED MACHINE

The present invention relates to a soundproof engine-operated machine such as an engine-operated generator for being stored in a closed container in a large-size vehicle.

Large-size vehicles such as buses have many electric loads such as an air-conditioning unit. Since these electric loads consume a large amount of electric power, the generator operated by the vehicle engine often fails to meet the electric power requirement. Therefore, it has been customary for large-size automobiles to carry a separate engine-operated generator. Such an additional engine-operated generator is normally contained in a storage space or container in one side of the vehicle body so that the engine-operated generator is soundproof.

The engine-operated generator stored in the container is composed essentially of an engine and a generator. One major concern about the engine-operated generator in the container is to provide suitable heat insulation around the engine and the generator which produce intensive heat during operation. Many engine-operated generators are generally air-cooled. To meet an increased power requirement, however, the engine output is large and the engine is preferably water-cooled. The water-cooled engine has a radiator and an associated cooling mechanism which are stored together with the engine in the container.

It is general practice to position the radiator, the engine, and the working unit such as a generator in one line. This layout however makes the entire engine-operated generator dimensionally large, and is not suitable for automobile-mounted generators which are subjected to many space limitations. It has therefore been desired that engine-operated machines for use on automobiles be small in outer profile. It is also desirable that engine-operated machines for use on other than automobiles should not be large in size.

The soundproof generators surrounded by the containers or boxes are cooled by air introduced through an opening defined in the container wall. The air introduced into the container tends to remain stagnant and be heated deeply back in the container. The heated stagnent air is not desirous for effective cooling capability even if fresh air is forcibly introduced by the radiator and the associated fan.

An exhaust system composed of an exhaust manifold and an exhaust pipe extends from the engine and includes a downstream portion projecting out of the lower wall of the container. The upstream portion of the exhaust system is positioned in the container and tends to increase the temperature in the container when heated. If the muffler attached to the end of the exhaust pipe is disposed outside of the lower container wall, the lower container wall is apt to be heated by heat radiation from the muffler, resulting in a temperature rise in the container.

SUMMARY OF THE INVENTION

The present invention has been made in an effort to eliminate the drawbacks experienced in cooling the conventional soundproof engine-operated machines such as generators for use on automobiles.

It is a first object of the present invention to provide a soundproof engine-operated machine such as an engine-operated generator housed in a container or box and surrounded thereby, the engine-operated machine including a water-cooled engine and a means for drawing air which would otherwise be kept stagnant deeply back in the container as air to cool the radiator of the engine for cooling the interior of the container deeply back therein as well as the other areas therein, while assuring an effective soundinsulating capability.

A second object of the present invention is to provide a soundproof engine-operated machine housed in a container or box and including an engine having an exhaust pipe having an upstream portion extending into the container and a downstream portion extending through the floor of the container therebelow, the engine-operated machine having a means for guiding air to cool the upstream portion of the exhaust pipe and discharging the air out of the container and below the floor to cool the downstream portion of the exhaust pipe, and a means for discharging air having cooled a radiator out of the container and below the floor through an air discharge hole below which a muffler is disposed, to thereby cool the muffler, so that the interior of the container will effectively be cooled by the air having cooled the engine and the radiator, and the floor will be prevented from being heated due to heat radiation from the muffler.

According to the present invention, there is provided a soundproof engine-operated machine including a floor having first and second air discharge hole, a wall member cooperating with the floor in defining a container, the wall member having an air inlet for introducing air into the container, a water-cooled engine disposed in the container, a first cooling fan disposed in front of said engine for delivering air from said air inlet toward said engine to cool the engine, a xachine unit such as a generator operable by the water cooled engine, a radiator attached to the engine, a second cooling fan disposed in front of the radiator for drawing air from behind the radiator therethrough, an exhaust pipe connected to the engine and extending below the floor, a muffler connected to a downstream portion of the exhaust pipe and disposed below the floor, a first means for guiding air from the engine around the exhaust pipe to cool the exhaust pipe and for discharging the air through the first air discharge hole, and a second means for discharging air from the radiator through the second air discharge hole to cool the muffler positioned below the second air discharge hole.

The above and further objects, details and advantages of the present invention will become apparent from the following detailed description of a preferred embodiment thereof, when read in conjunction with the accompanying drawings.

DESCRIPTION OF THE PREFERRED EMBODIMENT

The principles of the present invention are employed in an automobile-mounted engine-operated generator in the illustrated embodiment.

Figure 4:
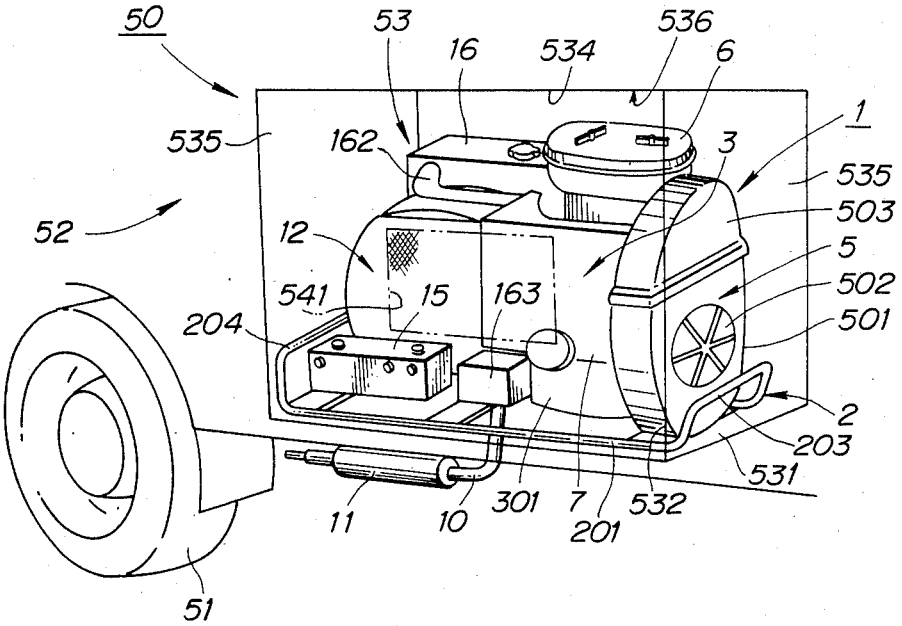
FIG. 4 is a perspective view of the engine-operated machine.
Figure 5:
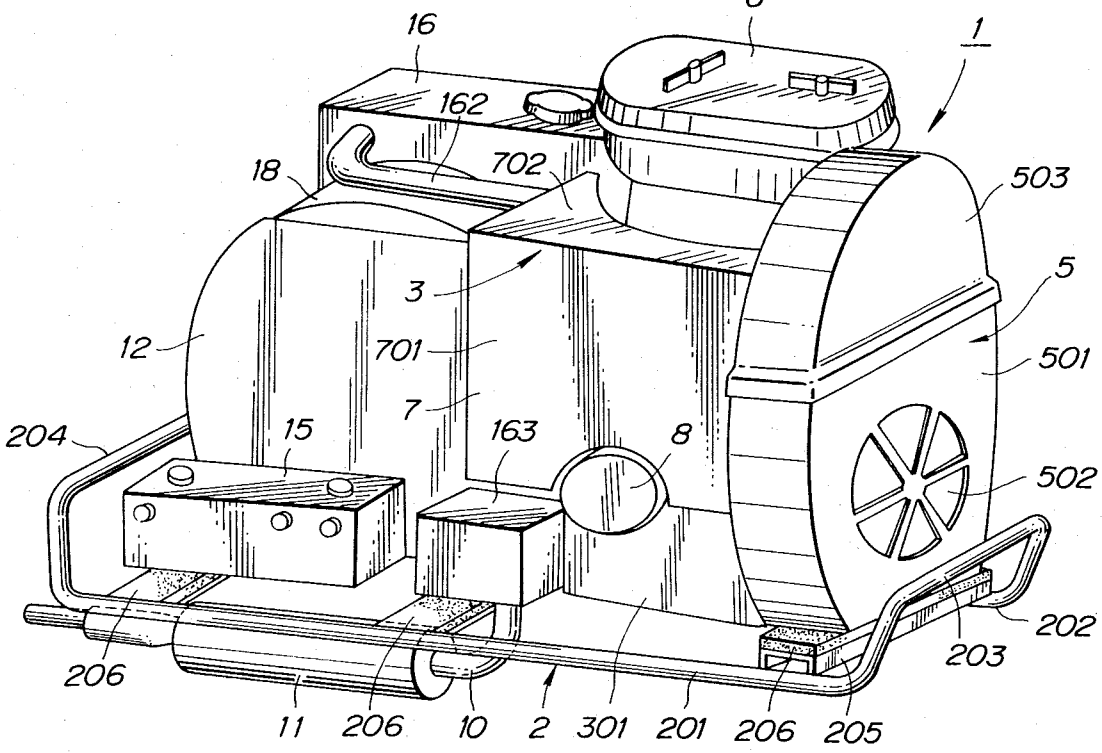
FIG. 5 is an enlarged perspective view of the engine-operated machine.

As shown in FIG. 4, an automobile 50 such as a bus has a cube-shaped container 53 positioned in a lower portion of an outer side panel 52 and extending in the transverse direction of the automobile 50 in front of one rear wheel 51. The container 53 is composed of a lower wall or floor 531, a front wall 532, a rear wall 533, an upper wall 534, and a back wall 535, the front and rear walls 532, 533 being spaced from each other in the longitudinal direction of the automobile 50. The lower wall 531, the front wall 532, the rear wall 533, and the upper wall 534 jointly define an opening 536 which opens at the outer side panel 52. The opening 536 is covered with an openable cover plate 54 (FIG. 1) having a central air inlet 541 in the form of a grid, a mesh screen, or a combination of slots, for example.

An engine-operated generator 1 is housed in the container 53. The engine-operated generator 1 will be described below with reference to FIGS. 1 through 5.

The engine-operated generator 1 is attached to and supported on a rectangular frame 2 which is elongate in the longitudinal direction of the automobile 50. The frame 2 comprises a piping composed of longer parallel side pipes 201, 202 and shorter front and rear pipes 203, 204. The front and rear pipes 203, 204 are vertically elevated with respect to the side pipes 201, 202 to serve as grips which can be manually gripped when the generator 1 is to be placed into the container 53. A water-cooled engine 3, which has two cylinders in the illustrated embodiment, is mounted on a front portion of the frame 2. A fan 4 is disposed in front of the engine 3 and covered with a fan cover 5 having an air inlet opening 502 defined in a lower end plate 501 thereof. The fan cover 5 has an upper portion 503 serving as an air guide shroud. An air cleaner 6 is disposed above the cylinder head of the engine 3. The cylinder head and the upper and outer sides of the engine cylinders are covered with a cover 7. The engine 3 has a crankcase 301 exposed in a lower position. An oil filter 8 is located between the crankcase 301 and the lower edge of the cover 7. The cover 7 is composed of a side member 701 covering the outer side of the engine cylinders and an upper member 702 bent from the upper edge of the side member 701 in covering relation to the cylinder head closely to the air inlet 541. The cover 7 is formed of pressed sheet steel or heat-resistant soundproof synthetic resin.

Figure 1:
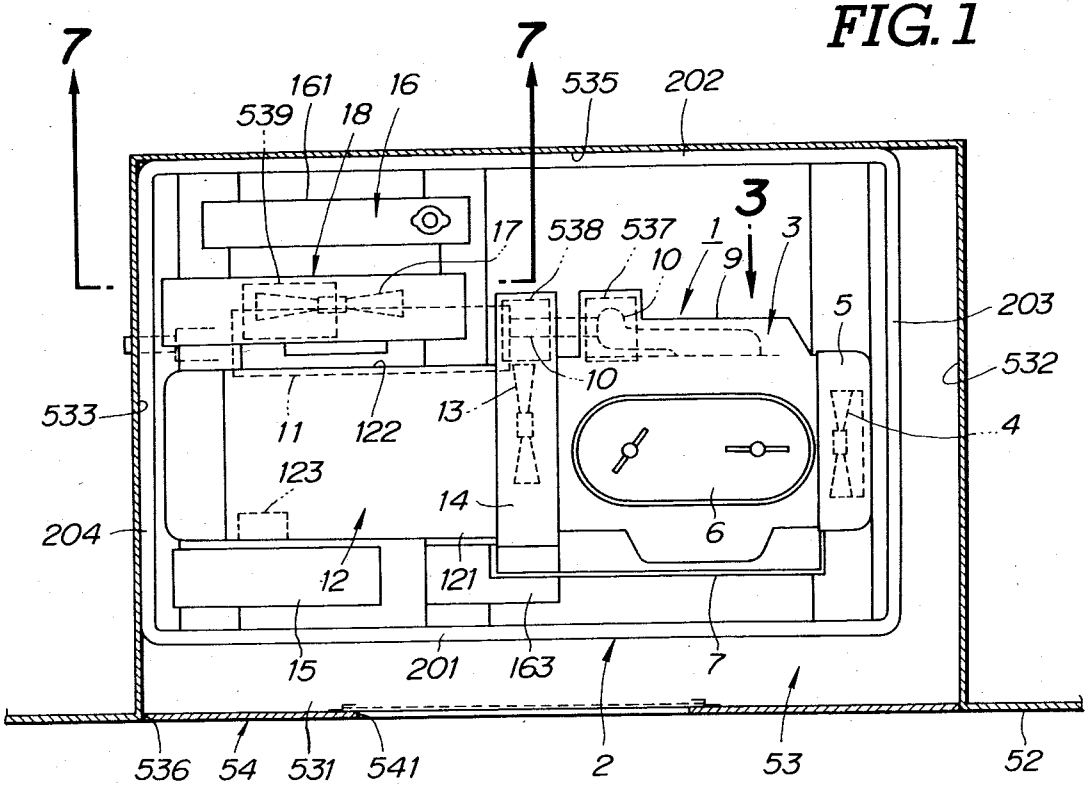
FIG. 1 is a plan view of an engine-operated machine according to the present invention, as installed on an automobile.
Figure 2:
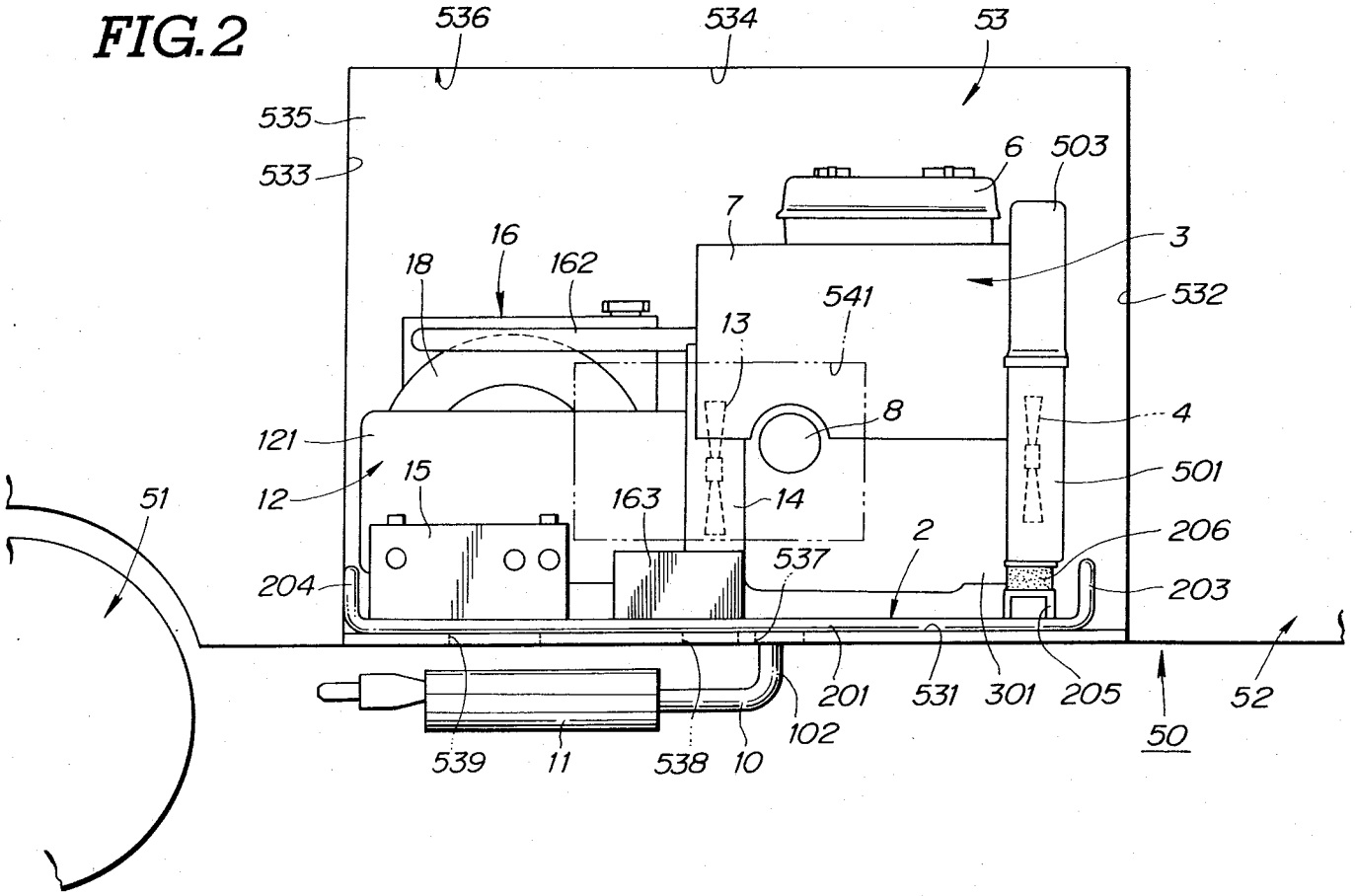
FIG. 2 is a front elevational view of the engine-operated machine shown in FIG. 1.
Figure 3:
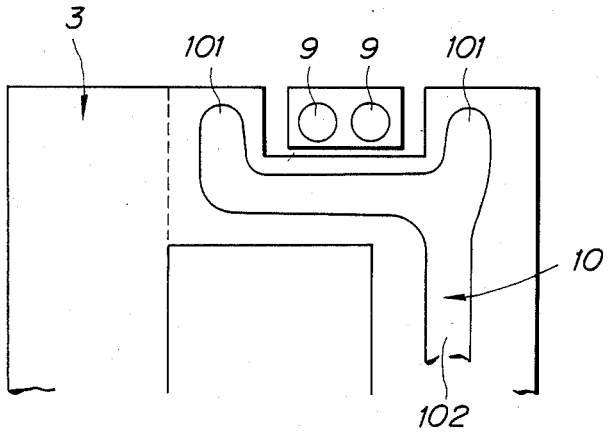
FIG. 3 is a fragmentary elevational view of the engine-operated machine as seen in the direction of the arrow 3 of FIG. 1.

As shown in FIGS. 1 and 3, a pair of intake pipes or manifolds 9 is disposed on the upper portion of the engine 3 remotely from the engine cover 7. An exhaust pipe 10 connected to two exhaust manifolds 101, 101 is also disposed remotely from the engine cover 7 in sandwiching relation to the intake pipes 9. The exhaust pipe 10 includes a downstream portion 102 downwardly extending below the frame 2 and bent rearwardly, the pipe portion 102 being connected to a muffler 11.

The generator 1 is fixedly stored in the container 53 with the frame 2 placed on the lower wall 531. With the generator 1 positioned in the container 53, the inner side pipe 202 has its outer side held against the lower portion of the back panel 535, and the rear pipe 204 is held against the lower portion of the rear wall 533. There are a clearance between the outer side pipe 201 and the cover plate 54 and also a clearance between the front pipe 203 and the front wall 532. There are also a space between the fan cover 5 and the front wall 532 and a space between the side of the engine 3 on which the exhaust manifolds 101 are supported and the back wall 535.

The generator 1 includes a generator unit 12 positioned behind the engine 3 in line therewith. The generator unit 12 has a tubular case 121 which is elongate in the longitudinal direction of the automobile 1, but has a width samller than that of the engine 3. A cooling fan 13 of the generator unit 12 is interposed between the generator unit 12 and the engine 3 and is covered with a cover 14. A control box 15 is positioned against the lower portion of the outer side of the generator unit 12, the control box 15 extending longitudinally from an intermediate position toward a rear position on the generator unit 12. The control box 15 faces the cover plate 54 which is openable to provide access to the control box 15. A reservoir tank 163 of a radiator 16 (described below) is disposed closely to the control box 15 and can be supplied with water when the cover plate 54 is open.

The radiator 16 is positioned in a space defined between an inner side 122 of the generator unit 12 and the back wall 535. The radiator 16 has a rear surface 161 confronting the back wall 535 in spaced relation thereto, and is spaced from the engine 3. The radiator 16 is spaced transversely from the generator unit 12, and is therefore not positioned in line with the engine 3, but faces transversely of the engine 3. The radiator 16 is positioned in the space alongside of the generator unit 12 which is smaller in diameter than the engine 3 and located in line with the engine 3. As a consequence, the entire engine-operated generator 1 is reduced in its longitudinal dimension or length. The entire engine-operated generator 1 is also reduced in its transverse dimension or width as the radiator 16 is located in the space alongside of the generator unit 12. Therefore, the engine-operated generator is small in outer profile and can easily be housed in the container 53 which occupies a relatively small space in the automobile 1. The container 53 itself may also be small in size.

A cooling fan 17 is interposed between the radiator 16 and the generator unit 12, the cooling fan 17 being surrounded by a fan cover 18. The downstream pipe portion 102 of the exhaust pipe 10 and the muffler 11 lie below the lower wall 531 and are positioned substantially downwardly of the fan 17.

The engine 3 and the generator unit 12 are supported in a vibroisolating manner on cross members 205 extending between the side pipes 201, 202. The lower wall 531 has an air discharge hole 537 through which the downstream pipe portion 102 is inserted, an air discharge hole 538 positioned behind the fan cover 14 of the generator unit 12, and an air discharge hole 539 below the fan cover 18 of the radiator 16. The air discharge holes 538, 539 are positioned above the exhuast pipe 10 and the muffler 11, respectively. The lower wall 531 also has an air inlet hole 123 positioned below the rear portion of the generator unit 12. The radiator 16 is connected to the engine 3 by a water pipe 162.

Figure 6:
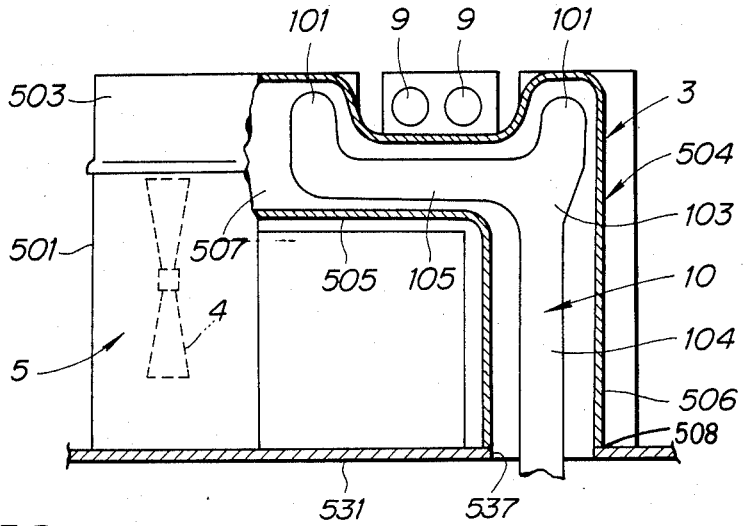
FIG. 6 is a detailed sectional elevational view of the engine-operated machine shown in FIG. 3.

FIG. 6 shows a cooling mechanism for the exhaust system in detail.

The exhaust pipe 10 also includes an upstream portion 103 contiguous to the exhaust manifolds 101 and a middle pipe portion 104 joined between the upstream portion 103 and the downstream portion 102. The exhaust manifolds 101, 101, the upstream portion 103, and the middle portion 104 are surrounded by a duct 504. As shown in FIG. 6, the duct 504 is of an inverted L shape including a horizontal portion 505 surrounding the exhaust manifolds 101, 101 and a joint portion 105 joining the exhaust manifolds 101, 101, and a vertical portion 506 surrounding the upstream and middle portions 103, 104. The vertical portion 506 has a lower end 508 connected to the air discharge hole 537 in the lower wall 531. The exhaust pipe 10 extends downwardly through the vertical portion 506 of the duct 504, and the downstream portion 102 of the exhaust pipe 10 extends through the air discharge hole 537 and is bent rearwardly below the lower wall 531, with the muffler 11 coupled to the downstream end of the portion 102. The duct 504 also includes an upstream portion 507 communicating with the fan cover 5 so that air from the fan 4 can flow through the duct 504 and be discharged out of the air discharge hole 537 below the lwer wall 531. The intake manifolds 9 are disposed outside of the duct 504 and hence isolated thereby from the exhaust manifolds 101, 101 and the joint portion 105.

Figure 8:
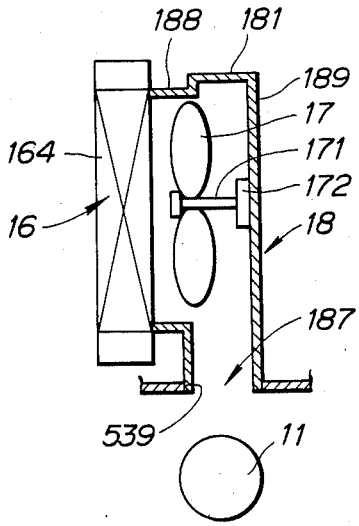
FIG. 8 is a cross-sectional view taken along line 8—8 of FIG. 7.
Figure 7:
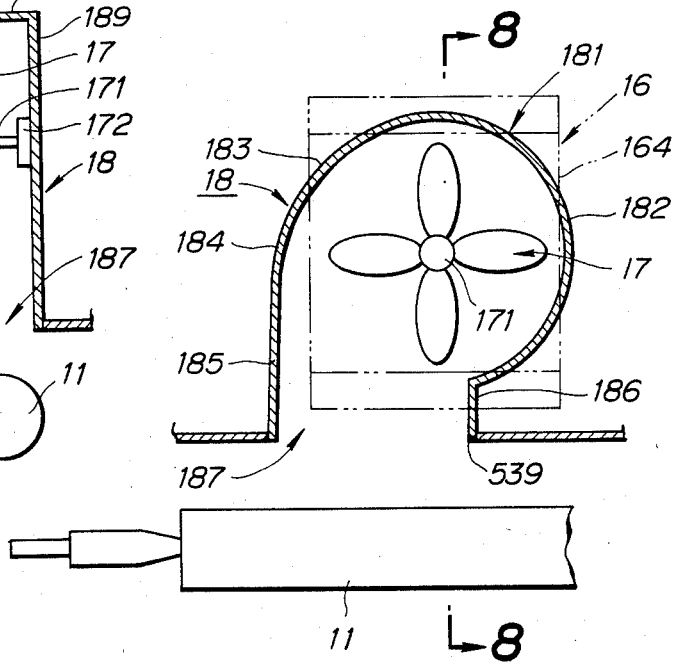
FIG. 7 is a cross-sectional view taken along line 7—7 of FIG. 1.

FIGS. 7 and 8 illustrate a cooling mechanism for the radiator 16. The fan 17 of the radiator 16 disposed alongside of the generator unit 12 comprises an axial-flow fan with the face cover 18 in the form of a scroll. The fan cover 18 comprises an arcuate body 181 including a semicylindrical portion 182 having an arcuate portion 183 of a larger radius of curvature, the arcuate portion 183 having an outer end wall 184 extending vertically downwardly as a longer side wall 185. A shorter side wall 186 extends vertically downwardly from the lower end of the semicylindrical portion 182 and is spaced from the longer side wall 185. The fan 17 has a shaft 171 located substantially upwardly of the shorter side wall 186. The side walls 185, 186 have lower ends defining an air discharge hole 187 connected to the air discharge hole 539 defined in the lower wall 531. On the side of the fan cover 18 which faces the radiator 16, there is disposed an axially short duct 188 larger in diameter than the fan 17 and surrounding the rear surface of the core 164 of the radiator 16. The fan cover 18 includes a scroll-shaped body 181 disposed behind the duct 188 and larger in diameter than the duct 188. A motor 172 is fixed to a rear wall of the fan cover 18 and has a shaft 171 projecting toward the rear surface of the radiator 16, the fan 17 being mounted on the shaft 171. The muffler 11 connected to the downstream end of the exhaust pipe 10 and extending below and parallel to the lower wall 531 in spaced relation thereto is disposed directly below the air discharge holes 187, 539.

The air passage positioned downstream of the core 164 serving as a heat exchanger in the direction of travel of cooling air is covered with the cover 18 so as to be insulated from the interior of the container 53 and is held in communication with the space below the lower wall 531 through the air discharge holes 187, 539.

Ambient air introduced through the air inlet 541 in the cover plate 54 into the container 53 is forced by the fan 4 into the cover 5 through the opening 502, from which the air is delivered by the upper cover portion 503 and the cover 7 to the exhaust manifolds 101, 101 to cool the same. Thereafter, the air is discharged through the air discharge hole 537 below the lower wall 531, during which time the exhaust pipe 10 is cooled.

Ambient air is also introduced through the air inlet hole 123 and forced by the fan 13 to flow through and cool the generator unit 12. The air is then discharged through the air discharge hole 538 below the lower wall 531 to cool the muffler 11 and the exhaust pipe 10.

The space in the container 53 enclosed by the engine 3, the generator unit 12, and the back wall 535 is remotest from the air inlet 541 and substantially completely surrounded by adjacent walls and parts. Therefore, air tends to remain stagnant in this space, and can easily be heated. As described above, the radiator 16 is positioned in this space, and the fan 17 is positioned in front of the radiator 16. When the fan 17 is driven, air between the rear surface 161 of the radiator 16 and the back wall 535 and between the engine 3 and the back wall 535 is drawn by the fan 17 to flow through the core 164 of the radiator 16 into the fan cover 18 of the fan 17, from which the air is discharged through the air discharge hole 531 below the lower wall 539 to cool the muffler 11. Since the space behind the radiator 16 and the engine 3 is large and can supply a sufficient amount of air which is to be drawn by the fan 17, ambient air can smoothly be drawn into the container 53 to effectively cool the interior of the container 53 for thereby preventing the interior of the container 53 from being subjected to an unwanted temperature rise which would otherwise be caused by stagnant air deeply back in the container 53.

The interior of the container 53, the engine 3 and the generator unit 12, and the exhaust system can effectively be cooled while assuring sound insulation capability of the container 53.

Air fed into the body 181 of the fan cover 18 hits the wall 189 and is turned thereby at a right angle. The air is then guided by the walls 182, 184 and discharged through the air discharge holes 187, 539 below the lower wall 531. The air is thus discharged out of the container 53, but does not flow back into the container 53. The radiator 16 discharges the largest amount of hot air among the other components in the container 53, and such hot air having cooled the radiator 16 is prevented from flowing back into the container 53 and does not have any adverse thermal effect on the interior of the container 53.

The air having cooled the radiator 16 is discharged through the air discharge hole 539 below the lower wall 531. Since the muffler 11 is disposed directly below the air discharge hole 539, the muffler 11 is cooled by the large amount of air from the radiator 16 which is of a relatively low temperature. The lower wall 531 is thus prevented from being heated by the heat radiation from the muffler 11. Consequently, any substantial temperature rise in the container 53 due to the muffler 11 can be avoided while positioning the muffler 11 below the lower container wall 531 and spacing the muffler 11 sufficiently from the road surface on which the automobile 1 travels.

With the arrangement of the present invention, as described above, the engine-operated machine or generator is housed in the container, and air in the container remotest from the air inlet is drawn by the fan into the radiator to cool the radiator. The air which would otherwise be kept stagnant remotely from the air inlet is utilized to effectively cool the interior of the container in which the engine-operated machine is accommodated. Therefore, the accessory parts other than the engine and the generator unit which have their own cooling mechanisms can be cooled and protected from heat.

While cooling the engine, the portions of the engine and the exhaust system which are exposed in the space in which the engine-operated machine is housed are cooled to cool the interior of the container. The hot air having cooled the interior of the container is not kept within the container, but is discharged below the lower wall of the container to thereby reduce or prevent a temperature rise in the container. The muffler disposed in the lower wall of the container and the exhaust pipe portion connected to the muffler can also be cooled by the air discharged from the container.

Inasmuch as the air discharged from the radiator is also discharged out of the container through the air discharge hole below which the muffler is positioned, the muffler can be cooled by the air discharged from the radiator. Any substantial temperature rise of the lower wall of the container which would otherwise be caused by heat radiation from the muffler is therefore prevented. As a result, the interior of the container can highly effectively be cooled. Since the muffler is cooled below the lower wall of the container, the muffler can be positioned closely to the lower container wall. Therefore, where the engine-operated machine is installed on an automobile, a sufficient clereance can be provided between the muffler and the road surface on which the automobile runs.

Where the present invention is applied to an automobile-mounted engine-operated generator as described above, the radiator is positioned laterally of the generator unit so that the entire engine-operated generator may be reduced in length, and the space alongside of the generator unit which is smaller in width than the engine is effectively utilized for the installtion of the radiator therein. Consequently, the engine-operated generator takes up a relatively small space in the automobile and can be small in its own size while allowing an increase in the power generation capacity of the generator. The engine-operated generator of high performance housed in the container permits the interior of the container to be effectively cooled.

The air having cooled the generator is discharged below the lower wall of the container through the air discharge holes above the exhaust pipe and the muffler, which can also effectively be cooled by the discharged air. The cooling of the exhaust pipe and the muffler with the discharged air is advantageous in that the container is prevented from any substantial temperature rise which would otherwise result from the heat radiation from the exhaust pipe and the muffler.

While the engine-operated generator has been described by way of example, the present invention is also applicable to other engine-operated machines such as engine-operated compressors.

Although there has been described what is at present considered to be the preferred embodiment of the present invention, it will be understood that the invention may be embodied in other specific forms without departing from the spirit or essential characteristics thereof. The present embodiment is therefore to be considered in all aspects as illustrative, and not restrictive. The scope of the invention is indicated by the appended claims rather than by the foregoing description.

We claim:

1. A soundproof engine-operated machine comprising:

a floor having first and second air discharge holes;

a plurality of wall members cooperating with said floor in defining a container, one of said wall members having an air inlet for introducing air into said container;

a water-cooled engine disposed in said container;

a first cooling fn disposed in said container in front of said engine for delivering air from said air inlet toward said engine to cool said engine;

a machine unit disposed in said container operable by said water-cooled engine;

a radiator attached to said engine within said container;

a second cooling fan disposed in said container in front of said radiator for drawing air from behind said radiator therethrough;

an exhaust pipe connected to said engine and extending below said floor;

a muffler connected to a downstream portion of said exhaust pipe and disposed below said floor;

first means for guiding air from said engine around said exhaust pipe to cool said exhaust pipe and for discharging the air through said first air discharge hole; and second means for discharging air from said radiator through said second air discharge hole to cool said muffler positioned below said second air discharge hole.

2. A soundproof engine-operated machine comprising:

a floor having an air discharge hole;

a plurality of wall members for defining a container cooperatively with said floor, one of said wall members having an air inlet for introducing ambient air from the exterior of said container to the interior of said container;

a water-cooled engine disposed in said container;

a machine unit disposed in said container, said machine unit being operable by said water-cooled engine;

a radiator attached to said engine within said container, said radiator having its rear surface in a confronting relationship to one of said wall members, said radiator having one of its side surfaces in a confronting relationship to another of said wall members being the furthest from said one of said wall members having said air inlet;

a cooling fan disposed in said container, said cooling fan being disposed in front of said radiator; and duct means disposed in said container so as to cover said cooling fan and contain said cooling fan within said duct means, said duct means connecting the front surface of said radiator to said air discharging hole of said floor so that by the function of said cooling fan the air in the interior of said container is drawn from said rear surface of said radiator into said duct to be discharged to the exterior of said container through said air discharge hole of said floor.

3. A soundproof engine-operated machine as set forth in claim 1, wherein said radiator has a radiator core serving as a heat exchanger, said first means comprising a duct covering said exhaust pipe and communicating with said first air discharge hole, said second means comprising a scroll-shaped cover disposed in covering relation to said second cooling fan and having a duct covering said radiator core, said scroll-shaped cover communicating with said second air discharge hole.

4. A soundproof engine-operated machine as set forth in claim 2, wherein said radiator has a radiator core serving as a heat exchanger, said duct means includes a scroll-shaped cover disposed in a covering relation to said cooling fan and a duct for covering said radiator core and communicating said radiator core with said scroll-shaped cover, and wherein said scroll-shaped cover communicates with said air discharge hole of said floor.

5. A soundproof engine-operated machine as set fourth in claim 1, including a sound-insulating cover disposed in partially covering relation to said engine, said engine having an intake system and an exhaust system including said exhaust pipe, said intake and exhaust systems being disposed remotely from said air inlet.

6. A soundproof engine-operated machine as set fourth in claim 2, including a sound-insulating cover disposed in partially covering relation to said engine, said engine having an intake system and an exhaust system including said exhaust pipe, said intake and exhaust systems being disposed remotely from said air inlet.

7. A soundproof engine-operated machine as set fourth in claim 1, wherein said machine unit comprises a generator.

8. A soundproof engine-operated machine as set fourth in claim 2, wherein said machine unit comprises a generator.

9. A soundproof engine-operated machine as set fourth in claim 1, wherein said radiator is disposed transversely of said machine unit.

10. A soundproof engine-operated machine as set fourth in claim 2, wherein said radiator is disposed transversely of said machine unit.

* * * * *